US006267248B1

(12) United States Patent
Johnson et al.

(10) Patent No.: US 6,267,248 B1
(45) Date of Patent: Jul. 31, 2001

(54) COLLATING AND SORTING APPARATUS

(76) Inventors: Rodney George Johnson, 13 Grenaside Court, Robina, Queensland 4226; Mark William Piacun, 141 Alison Rd., Carrara, Queensland 4211, both of (AU)

( * ) Notice: Subject to any disclaimer, the term of this patent is extended or adjusted under 35 U.S.C. 154(b) by 0 days.

(21) Appl. No.: 09/380,943

(22) PCT Filed: Mar. 13, 1998

(86) PCT No.: PCT/AU98/00157

§ 371 Date: Sep. 13, 1999

§ 102(e) Date: Sep. 13, 1999

(87) PCT Pub. No.: WO98/40136

PCT Pub. Date: Sep. 17, 1998

(30) Foreign Application Priority Data

Mar. 13, 1997 (AU) ..... P05640

(51) Int. Cl.[7] ..... B07C 5/00

(52) U.S. Cl. ..... 209/547; 209/509; 209/546; 273/149 R; 273/149 P; 463/22; 463/16

(58) Field of Search ..... 209/534, 535, 209/552, 553, 554, 559, 560, 564, 569, 706; 273/149 R, 149 P

(56) References Cited

U.S. PATENT DOCUMENTS

| | | | |
|---|---|---|---|
| 2,001,220 | | 5/1935 | Smith . |
| 2,016,030 | | 10/1935 | Woodruff et al. . |
| 2,778,644 | | 1/1957 | Stephenson . |
| 2,950,005 | | 8/1960 | MacDonald . |
| 3,595,388 | * | 7/1971 | Castaldi ..... 209/111.8 |
| 3,897,954 | | 8/1975 | Erickson et al. . |
| 4,388,994 | * | 6/1983 | Suda et al. ..... 209/564 |
| 4,497,488 | | 2/1985 | Plevyak et al. . |
| 4,515,367 | | 5/1985 | Howard . |
| 4,586,712 | * | 5/1986 | Lorber et al. ..... 273/149 R |
| 4,659,082 | * | 4/1987 | Greenberg ..... 273/149 R |
| 4,667,959 | | 5/1987 | Pfeiffer et al. . |
| 4,759,448 | | 7/1988 | Kawabata . |
| 4,876,000 | | 10/1989 | Mikhail . |
| 5,121,921 | | 6/1992 | Friedman et al. . |
| 5,356,145 | | 10/1994 | Verschoor . |
| 5,431,399 | | 7/1995 | Kelley . |
| 5,989,122 | | 11/1999 | Roblejo . |

* cited by examiner

*Primary Examiner*—Donald P. Walsh
*Assistant Examiner*—Mark J. Beauchaine
(74) *Attorney, Agent, or Firm*—Mark A. Litman & Associates, P.A.

(57) ABSTRACT

A collation and/or sorting apparatus for groups of articles is exemplified by a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines according to a preprogrammed routine whether cards identified by sensor (15) are collated in the magazine (20) as an ordered deck of cards or a randomly ordered or "shuffled" deck.

44 Claims, 2 Drawing Sheets

COLLATING AND SORTING APPARATUS

FIELD OF THE INVENTION

This invention relates to collation and/or sorting of groups of articles.

In particular, this invention relates to shuffling and sorting apparatus for providing randomly collated groups of articles and/or collated groups of articles according to a predetermined order.

This invention can be utilised to collate and sort groups of articles which have distinguishing characteristics which can be machine identified. However it has particular relevance to shuffling and sorting playing cards and reference will be made hereinafter to such application by way of illustration of the invention.

BACKGROUND OF THE INVENTION

In the gaming industry many packs of cards are utilised and it is necessary to shuffle one or more decks of cards for game use and/or after each game to sort the cards into one or more packs for re-use either in a specific order or at least into a pack of cards which is complete. At present this is achieved manually.

SUMMARY OF THE INVENTION

This invention aims to provide a collation and/or sorting apparatus which will operate efficiently and accurately.

With the foregoing in view, this invention in one aspect resides broadly in collation and/or sorting apparatus including:

sensor means to identify articles for collation and/or sorting;

feed means for feeding said articles sequentially past the sensor means;

storing means in which articles may be collated in groups in a desired order;

selectively programmable computer means coupled to said sensor means and to said storing means to assemble in said storing means groups of articles in a desired order;

delivery means for selectively delivering the individual articles into the storing means, and collector means for collecting collated groups of articles.

The sensor means may include means to identify the presence of an article.

Suitably the sensor means includes means to identify one or more physical attributes of an article.

Preferably the sensor means includes means to identify indicia on a surface of an article.

The desired order may be a specific order of a set of articles, such as a deck of cards to be sorted into its original pack order, or it may be a random order into which a complete set of articles is delivered from a plurality of sets of randomly arranged articles For example the desired order may be a complete pack of playing cards sorted from holding means which holds a plurality of randomly oriented cards forming a plurality of packs of cards. This may be achieved by identifying the individual cards by optical readers, scanners or any other means and then under control of a computer means such as a micro-processor, placing an identified card into a specific collector means to ensure delivery of complete decks of cards in the desired order. The random number generator is used to place individual cards into random positions to ensure random delivery of one to eight or more decks of cards. In one aspect the apparatus is adapted to provide one or more shuffled packs of cards, such as eight packs for the game of baccarat.

The storing means may have individual storing spaces for each respective article to be provided as the collated and/or sorted stack of articles. In such arrangement the delivery means delivers identified articles to the respective storing spaces. This may be achieved by arranging the delivery means with travel means movable along a plurality of axes such as laterally to a column of individual storing spaces and vertically along the column.

Preferably however the storing means is arranged as one or more rotatable storage magazines and the delivery means includes a delivery carriage movable to a respective magazine and drive means for rotating the magazine to operatively align a respective storing space with the delivery carriage.

The collector means may be arranged to receive articles from the storing means as a collated group of articles. For example the storing means may simultaneously release all the articles therein into the collector means which may be a confining chute in which the articles settle as a group. Preferably however the collector means operates after a complete set of articles has been collated in the storing means and sequentially feeds the sorted articles into one or more discrete groups.

The sensor means may be any suitable means for identifying a physical characteristic of the articles to be sorted or it may comprise sensor means for detecting and/or interpreting electromagnetic signals reflected and/or transmitted by an article.

One form of the invention is provided as a sorting apparatus for providing a pack of playing cards arranged in original deck order and includes:

sensor means able to identify the suit and value of individual cards;

feed means for feeding the said cards sequentially past the sensor means;

storing means having individual storing spaces for each respective card of a deck of cards;

selectively programmable computer means coupled to said sensor means and said storing means to assemble in said storing means individual cards comprising a complete deck or respective decks of cards;

delivery means for delivering the identified cards or collated decks thereof to pre-selected individual storing spaces, and collector means for collecting one or more decks of cards.

Another form of the invention comprises a card shuffling device to randomly shuffle one or more decks of cards.

Preferably the storing means is arranged as one or more rotatable magazines and the delivery means includes a delivery carriage which receives identified cards from the feed means and is movable along a horizontal drive path in front of a plurality of magazines arranged co-axially and with their common axis parallel to the drive path and which are rotatable together or independently by the computer means to operatively align a respective storing space with the delivery carriage.

The respective storing spaces may include retention means adapted to captively hold a delivered card therein.

The retention means may comprise a vacuum clamping means but preferably the magazine is formed as a quadrant having a lower shroud which prevents dislodgement of the cards from the storing spaces when in an inverted position.

After collation of one or more decks, the magazine or each magazine may be rotated to sequentially engage retained cards with conveying means which conveys collated decks of cards which sequentially come into engagement therewith to a collector means.

BRIEF DESCRIPTION OF THE DRAWINGS

In order that this invention may be more readily understood and put into practical effect, reference will be made to accompanying drawings which illustrate schematically one embodiment of playing card sorting and or shuffling apparatus, wherein.

DETAILED DESCRIPTION OF THE DRAWINGS

Figure 1:
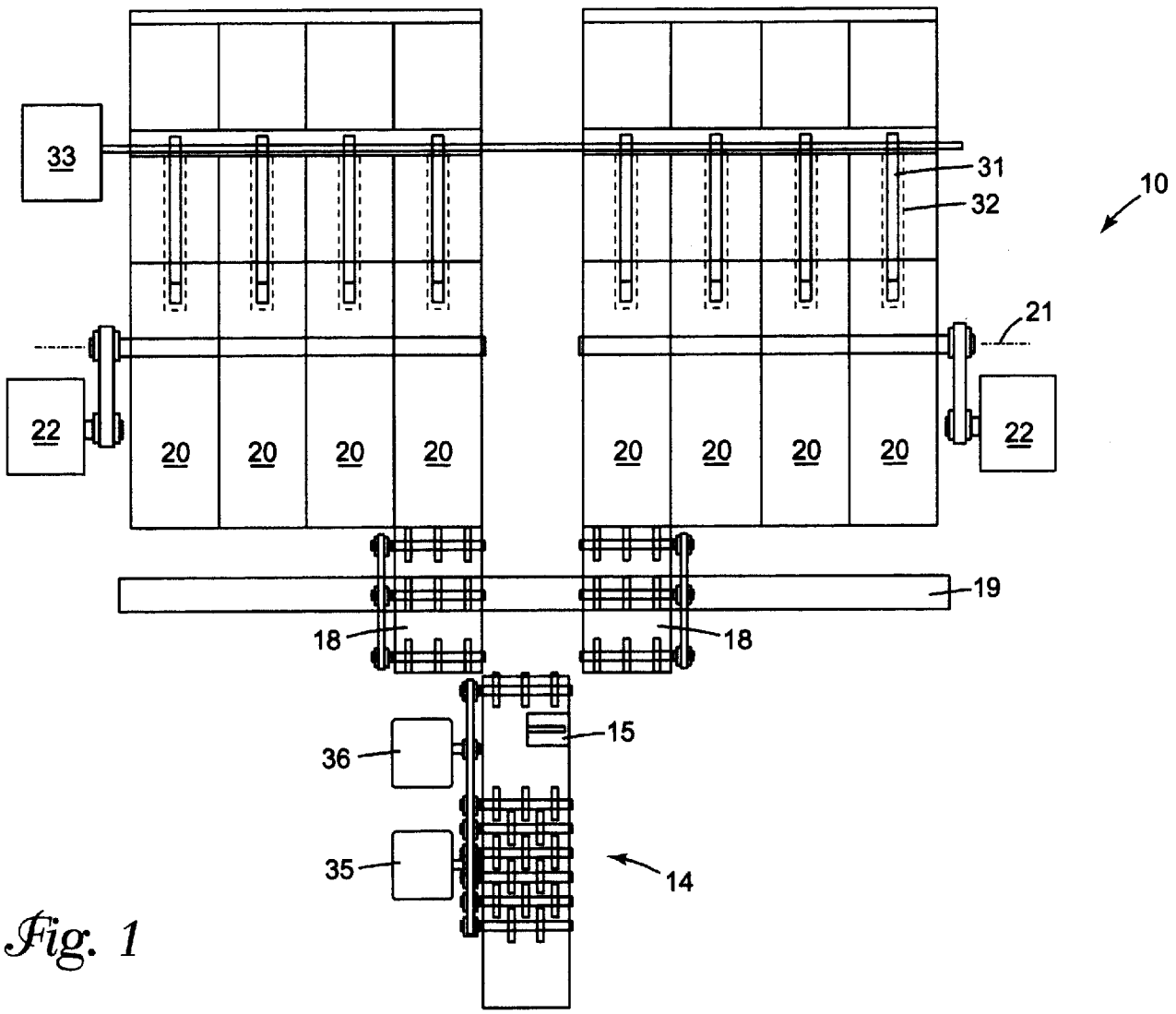
FIG. 1 is a plan view of the apparatus.
Figure 2:
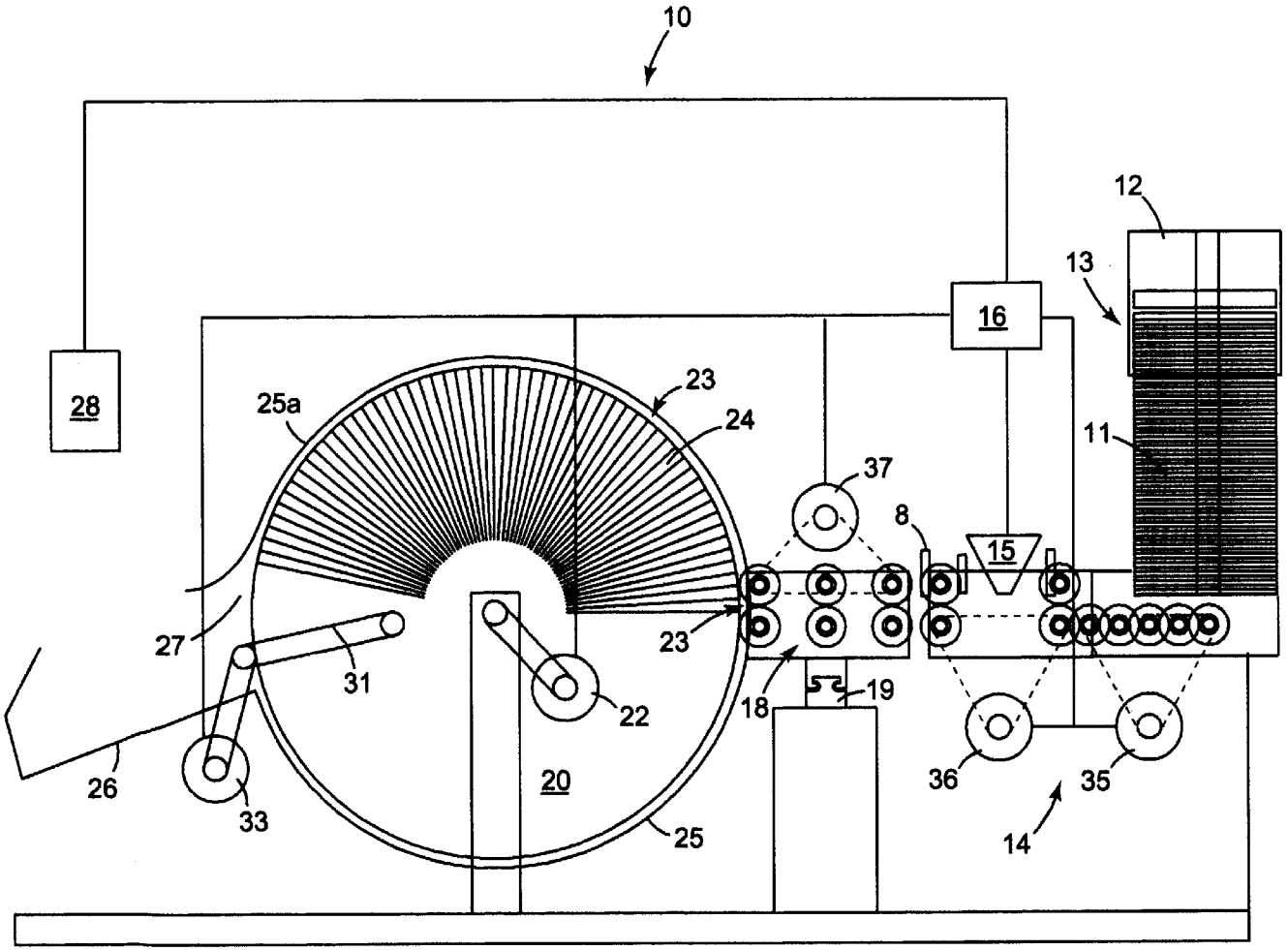
FIG. 2 is a typical sectional view of the apparatus.

The collating apparatus 10 for providing sorted and/or shuffled decks of playing cards from a stack of cards 11 includes holding means 12 for holding the cards in a vertical column 13 above card feed means 14 which feeds the lowermost card of the stack past the sensor 15 which is coupled to a microprocessor 16 to record either the presence of a card and/or the identity of a card by its suit and value. Microprocessor 16 is also coupled to drive motors 35, 36 of feed means 14, respective drive means (not shown) for transverse movement of each carriage 18, card transport drives 37 associated with carriages 18, magazine drives 22 and drive 33 associated with unloading conveyors 31 for selective coordinated operation to collate packs of shuffled or sorted cards.

The feeding means 14 delivers each card past the sensor 15 to a selected one of a pair of delivery carriages 18. Each delivery carriage 18 is movable along a common horizontal track 19, transverse to the direction of movement of the cards from the feed means 14, and disposed in front of a plurality of card magazines 20 arranged co-axially and with their common axis 21 parallel to the drive path 19. In this embodiment there are two banks of four magazines 20 arranged in side by side relationship at opposite sides of the feeding means 14.

Each bank of magazines 20 is driven by a motor 22 which is suitably a reversible stepper motor or by a motor drive and brake system to achieve selective incremental rotation of magazines 20 to align openings 23 of card storing spaces 24 with delivery carriages 18 to permit a card to be inserted into a respective storing space 24.

A lower shroud 25 extends beneath the respective banks of magazines 20 to maintain the cards in their respective individual storing spaces 24 and an upper shroud 25*a* terminating in outlet port 27 prevents interference with what otherwise would be exposed storing spaces in the upper part of magazine 20. Shroud 25 extends from the delivery carriages to an associated collecting tray 26 adapted to hold respective card packs.

As illustrated there are fifty-six individual storing spaces 24 arranged in an upper sector of the magazine and these radiate outwardly from the axis 21 and fill the space between the outlet port 27, adjacent an unloading conveyor 31, and the output of the delivery carriages 18.

Thus the drive motor 22 may be actuated to position any one of the fifty-six individual storing spaces 24 in operative alignment with the output of delivery carriages 18 while maintaining the rearmost storing space 24 clear of the unloading conveyor 31.

Individual motors 35 and 36 control the feeding of the cards from the column 13 and from the field of sensor 15 and further motors 37 on respective delivery carriages 18 control movement of the cards thereon into the storage spaces 24. A further motor, not illustrated, controls the movement of each delivery carriage 18 and may be a motor driving a transverse screw shaft coupled to the carriages or a belt drive or other means of driving to control their transverse travel.

In a sorting mode, microprocessor or like programmable control means 16 operates to feed cards from the column 13 sequentially past the sensor 15 which identifies each individual card and commits it to memory with an identification such as a number which corresponds to the sequentially identified storage spaces 24 of a particular magazine 20. More than one deck of cards can be identified and the program will select between these when sorting. Thus when the cards are next fed from the column 13 they will be recognised and fed to a corresponding storage space 24 in a respective magazine 20.

Once a storage space 24 is filled the next card so identified will be fed to an allocated storage space 24 in the same magazine unless a card of identical suit and value previously has been identified in which case that card is allocated to a respective storage space 24 in one of the other magazines 20. This process is repeated until all cards have been sorted and stored.

Thereafter, the magazines are rotated anticlockwise as shown towards the unloading conveyors 31 driven in unison by motor 33 until respective conveyors 31 are contacted by the first card in each magazine 20 which card thus will be discharged to the collector tray 26. Unloading conveyors 31 are narrow belts aligned with slotted apertures 32 extending radially of the respective radial walls forming storing spaces 24. The further cards in each magazine will then be sequentially discharged to the collector tray 26 to form packs of sorted cards.

If at the end of sorting any deck of cards is incomplete or over supplied a warning signal will be actuated in association with that deck to indicate the incomplete or oversupplied stack of cards. By actuating an LCD or LED display 28 this will indicate which card is missing or over supplied and will also then indicate any other deck which is incomplete or over supplied. The LCD or LED display 28 may, if required indicate the magazine location in which a card is undersupplied or oversupplied to form a complete deck.

It will be seen that the illustrated apparatus may have eight or more or less magazines arranged in groups of four or more or less with common actuation of the unloading conveyor and separate operation of the motors which control their pivotal position.

In a shuffling mode for a single pack of cards, sensor 15 may or may not be actuated to detect the suit and value of each card. If it is not required to determine the integrity of a pack of cards other than completeness by counting the number of cards, sensor 15 may be actuable to detect only the presence of a card as it passes from feeding means 14 to delivery carriage 18.

As each card is passed beneath sensor 15 its presence is detected and microprocessor 16, using a random number generator, randomly allocates that card to a predetermined one of the fifty six storage spaces 24 of magazine 20. Microprocessor 16 then controls drive motors 36, 37 and 22 to effect delivery of the card into the randomly predetermined storage space 24.

When the magazine is full and up to fifty six cards have been accounted for, magazine 20 is rotated anticlockwise to permit conveyor 31 to discharge a pack of randomly ordered or "shuffled" cards into collector tray 26.

On the other hand, if a multiplicity of decks is to be shuffled for reuse in a game such as baccarat employing like decks of shuffled cards, it may be important to produce eight individually shuffled decks and/or to determine whether cards have been removed or added to the eight deck stack of cards retrieved from the playing table.

In this case sensor 15 would be operated to determine not only the presence of a card on feed means 14 but also the suit and value of each card to enable loading of the eight magazines each with a randomly ordered or shuffled deck of cards which is otherwise complete.

It will of course be realised that while the above has been given by way of illustrative example of this invention, all such and other modifications and variations hereto. as would be apparent to persons skilled in the art, are deemed to fall within the broad scope and ambit of this invention as is herein set forth.

For example a reject mechanism 8 may be associated with the sensor 15 to cause duplicate or oversupplied cards to be rejected before delivery by delivery means 18 to the magazine 20. The reject mechanism 8 may comprise an electromechanical device or air blast means coupled to a microprocessor 16.

The rotatable magazine 20 may be substituted by a vertically displaceable magazine or any other storage device having a plurality of storage spaces to receive individual cards. Similarly for other applications the holding means 12 and feeding means 14 may be replaced by a rotary turntable having a selectively actuable finger guide to remove articles from the turntable.

It readily will be apparent to a skilled addressee that the apparatus according to the invention will have an application in the collation and packaging of cards during their manufacture to ensure the integrity of each set of cards produced.

Equally, it readily will be apparent to a skilled addressee that the invention, with suitable modifications, will have wide application in fields where sets of articles are to be collated and bundled in a predetermined order or in a random order or otherwise where the grouping or collation of articles by number and/or order is essential.

Such applications may include collation of book pages in the correct order with a mixture of black and white and coloured pages from different printing presses; packaging of mixed sets of food items ie. breakfast cereal: dispensing and packaging of mixtures of pills for patients on a daily or weekly basis; sorting and packaging of eggs or fruit by size and/or colour; sorting and collation of mail by zip code; sorting and collation of bank cheques by payee, payer or bank; collation and sorting of bank notes by denomination, condition or integrity or even sorting and collation of doctors prescription forms to monitor information on patients, drug prescribed, pharmacy or prescribing doctor.

The present invention is able to collate and/or sort articles by physical attributes such as size, colour, shape, mass (eg. by load cell or the like) or surface indicia or any combination thereof.

What is claimed is:

1. An apparatus for arranging playing cards in a desired order, said apparatus including:

a housing;

a sensor to sense playing cards prior to arranging;

a feeder for feeding said playing cards sequentially past the sensor;

a storage assembly having a plurality of storage locations in which playing cards may be arranged in groups in a desired order, wherein the storage assembly is adapted for movement in at least two directions during shuffling;

a selectively programmable computer coupled to said sensor and to said storage assembly to assemble in said storage assembly groups of playing cards in a desired order;

a delivery mechanism for selectively delivering playing cards located in selected storage locations of the storage assembly; and a collector for collecting arranged groups of playing cards.

2. The apparatus of claim 1 wherein the storage assembly comprises a carousel that rotates with respect to the delivery mechanism.

3. The apparatus of claim 1 wherein the storage assembly comprises at least eight adjacent magazines that move vertically with respect to the delivery mechanism.

4. The apparatus of claim 1 wherein the desired order is a random order of cards.

5. The apparatus of claim 1 wherein the desired order is a preselected order of cards.

6. The apparatus of claim 1 wherein the sensor senses only the presence of a card.

7. The apparatus of claim 1 wherein the sensor senses the value of the card.

8. The apparatus of claim 1 wherein the sensor is an optical reader.

9. The apparatus of claim 1 wherein the storage assembly is a vertical rack.

10. The apparatus of claim 1 wherein the storage assembly is a carousel.

11. The apparatus of claim 1, wherein the feeder is capable of withdrawing individual playing cards from the group of playing cards and feed individual playing cards sequentially past the sensor.

12. An apparatus as claimed in claim 1, wherein the sensor includes means to identify the presence of a playing card.

13. An apparatus as claimed in claim 12 wherein the sensor is adapted to identify one or more physical attributes of a playing card.

14. An apparatus as claimed in claim 13 wherein the sensor is adapted to identify indicia on a playing card.

15. An apparatus as claimed in claim 14 wherein the sensor comprises a scanning device.

16. An apparatus as claimed in claim 10 wherein the sensor is adapted to detect electromagnetic signals reflected and/or transmitted by a playing card.

17. An apparatus as claimed in claim 1 wherein the feeder is adapted to withdraw individual playing cards from a group of playing cards and feed said individual playing cards sequentially past the sensor.

18. An apparatus as claimed in claim 12 wherein the feeder includes a conveyor.

19. An apparatus as claimed in claim 1 wherein the storage assembly comprises one or more storage magazines each having a plurality of storage spaces.

20. An apparatus as claimed in claim 19 wherein said one or more storage magazines each include a predetermined number of individual storage spaces corresponding to the number of playing cards in a pack.

21. An apparatus as claimed in claim 20 wherein individual storage spaces are selectively indexable with said delivery mechanism.

22. An apparatus as claimed in claim 21 wherein the storage assembly comprises spaced storage spaces displaceable along an upright axis relative to said delivery mechanism.

23. An apparatus as claimed in claim 21 wherein the storage assembly comprises circumferentially spaced storage spaces displaceable relative to said delivery mechanism.

24. An apparatus as claimed in claim 19 wherein said delivery assembly comprises a conveyor.

25. An apparatus as claimed in claim 24 wherein the delivery assembly is displaceable between adjacent storage magazines.

26. An apparatus as claimed in claim 25 including at least two delivery assemblies.

27. An apparatus as claimed in claim 19 wherein said collector is adapted to collect a collated group of playing cards.

28. An apparatus as claimed in claim 27 including respective collectors for each said storage magazine.

29. An apparatus as claimed in claim 28 wherein the collector includes a playing card extractor to assist in extraction of playing cards from respective individual storage spaces.

30. An apparatus as claimed in claim 1 wherein said programmable computing means includes data memory and data storage capacity to store data relating to each individual playing card sensed by the sensor.

31. An apparatus as claimed in claim 30 including a random number generator for randomly allocating playing cards to said storage assembly.

32. The apparatus of claim 1 wherein the storage assembly comprises a stack that moves vertically with respect to the delivery mechanism.

33. The apparatus of claim 32, wherein the delivery mechanism travels along a linear horizontal line, wherein the collector comprises at least eight adjacent magazines that rotate about an axis substantially parallel to the linear horizontal line of the delivery mechanism.

34. The apparatus of claim 33, wherein the feeder comprises a conveyor.

35. A method for sorting a pack of playing cards, said method comprising the steps of:

feeding individual cards past a sensor to determine suit and value of individual cards and transmitting sensor signal data to a computer;

computing sensor signal data for each respective card and allocating thereto a predetermined value corresponding to the order of a particular card in a sorted pack;

delivering sensed cards to a collator having an individual storage space allocated to a card of predetermined suit and value;

indexing said collator with a delivery mechanism to deliver each said sensed card to a respective storage space of said collator; and sequentially removing said cards from said collator to form a sorted pack of playing cards.

36. A method as claimed in claim 35 wherein said pack of cards comprises one or more decks of cards.

37. A method of shuffling a pack of cards, said method comprising the steps of:

feeding cards by means of a card delivery mechanism individually past a sensor to determine the presence of each card and transmitting sensor signal data to a computer;

computing sensor signal data for each respective card and allocating thereto a value generated by a random number generator corresponding to a storage space in a collator;

delivering sensed cards to a collator having a plurality of storage spaces;

indexing said collator with a card delivery mechanism to deliver each said card to the corresponding storage space of said collator, wherein relative motion between the collator and card feeder is in at least two directions during shuffling; and collecting cards from said collator to form a randomly ordered pack of playing cards.

38. A method as claimed in claim 37 wherein said pack comprises one or more decks of cards.

39. A method as claimed in claim 38 wherein said sensor is adapted to determine the suit and/or value of individual cards.

40. A card sorting device, comprising:

a housing:

an infeed receptacle for accepting cards to be fed;

a card moving mechanism for moving cards from the infeed receptacle to a storage device;

a storage device comprising a plurality of compartments for receiving cards to be sorted;

a mechanism for moving the storage device relative to the card moving mechanism to permit card placement in different compartments in the card storage device;

a card unloading device for removing cards from the compartments in the card storage device; and a selectively programmable microprocessor for selecting a compartment in the card storage device to receive each card being moved and for changing a direction of movement of the storage device during shuffling.

41. The card sorting device of claim 40 further comprising a sensor for sensing cards prior to insertion into compartments in the storage device.

42. The card sorting device of claim 40 wherein the storage device is a stack of compartments.

43. The card storing device of claim 40 wherein the storage device is a carousel.

44. The card storage device of claim 40 wherein each compartment in the card storage device receives only a single card.

* * * * *

UNITED STATES PATENT AND TRADEMARK OFFICE

CERTIFICATE OF CORRECTION

PATENT NO. : 6,267,248 B1 
DATED : July 31, 2001
INVENTOR(S) : Rodney George Johnson and Mark William Piacun It is certified that error appears in the above-identified patent and that said Letters Patent is hereby corrected as shown below:

Title page,
Item [73], Assignee, insert:
-- [73] Assignee: Shuffle Master, Inc., Eden Prairie, MN (US) --

Signed and Sealed this

Twenty-fifth Day of February, 2003

JAMES E. ROGAN
*Director of the United States Patent and Trademark Office*